US009051937B2

(12) United States Patent
Kubota et al.

(10) Patent No.: US 9,051,937 B2
(45) Date of Patent: Jun. 9, 2015

(54) REFRIGERANT COMPRESSOR

(71) Applicant: Panasonic Corporation, Kadoma-shi, Osaka (JP)

(72) Inventors: Akihiko Kubota, Kyoto (JP); Jun Sato, Shiga (JP); Akio Yagi, Shiga (JP); Masato Morishima, Shiga (JP); Yuji Mori, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 407 days.

(21) Appl. No.: 13/672,826

(22) Filed: Nov. 9, 2012

(65) Prior Publication Data

US 2013/0121809 A1 May 16, 2013

(30) Foreign Application Priority Data

Nov. 11, 2011 (JP) ..... 2011-247160

(51) Int. Cl.

| | |
|---|---|
| ***F04B 39/02*** | (2006.01) |
| ***F04D 27/00*** | (2006.01) |
| ***F04B 39/00*** | (2006.01) |
| ***F04D 27/02*** | (2006.01) |

(52) U.S. Cl.

CPC ..... *F04D 27/00* (2013.01); *F04B 39/00* (2013.01); *F04D 27/02* (2013.01)

(58) Field of Classification Search

CPC .... F04B 39/00; F04B 39/023; F04B 39/0238; F04B 39/0292; F04D 27/00; F04D 27/02

See application file for complete search history.

(56) References Cited

U.S. PATENT DOCUMENTS

| | | | | |
|---|---|---|---|---|
| 5,118,263 | A * | 6/1992 | Fritchman | 92/158 |
| 6,279,456 | B1 * | 8/2001 | Ueshima et al. | 92/153 |
| 7,421,940 | B2 * | 9/2008 | Nissen et al. | 92/159 |
| 2010/0008808 | A1 * | 1/2010 | Yoshimi et al. | 418/63 |

FOREIGN PATENT DOCUMENTS

JP 2783381 B 5/1998

* cited by examiner

*Primary Examiner* — Thomas E Lazo

(74) *Attorney, Agent, or Firm* — Hamre, Schumann, Mueller & Larson, P.C.

(57) ABSTRACT

A refrigerant compressor comprises an electric element; a compression element; and a sealed container; wherein the compression element includes: a crankpin; a piston pin; and a connecting rod having a large hole portion into which the crankpin is inserted, a small hole portion in which the piston pin is rotatably disposed, and a coupling rod portion; wherein an oil guide hole is provided in the coupling rod portion of the connecting rod such that the large hole portion and the small hole portion are communicated with each other via the oil guide hole; a circular first groove is provided on an outer peripheral surface of the piston pin such that the first groove communicates with the oil guide hole; and a second groove extending in a center axis direction of the piston pin is provided in a first region of the small hole portion of the connecting rod.

3 Claims, 6 Drawing Sheets

REFRIGERANT COMPRESSOR

BACKGROUND OF THE INVENTION

1. Field of the Invention

The present invention relates to a refrigerant compressor used in a refrigeration cycle such as a refrigerator.

2. Description of the Related Art

As a refrigerant compressor used in a refrigeration cycle such as a refrigerator, there is a refrigerant compressor which includes a connecting rod attached with a crankpin and a piston pin at both ends thereof such that the crankpin and the piston pin are slidable, and converts an eccentric motion of the crankpin caused by a rotational motion of a crankshaft into a reciprocation motion of a piston, thereby obtaining a compression action. In the refrigerant compressor, the piston pin and a hole portion of the connecting rod are applied with a great surface pressure (load) during the compression action and thereby wear out.

As a solution to this, a sealed compressor is known, which includes an oil feed hole extending inside of a connecting rod, and an oil feed groove provided on a sliding surface of a piston pin which slides on a wall portion of a small end hole of the connecting rod so as to extend in a center axis direction of the piston pin, and positioned so as to communicate with the oil feed hole when the piston is moving from a top dead center to a bottom dead center (see, e.g., Japanese Patent No. 2783381).

FIG. 6 is a cross-sectional view of a piston device of the sealed compressor disclosed in Japanese Patent No. 2783381.

Referring to FIG. 6, the sealed compressor disclosed in Japanese Patent No. 2783381 includes a piston 2, a connecting rod 7 having a small end hole 8 at one end thereon and a large end hole 9 at the other end thereof, an oil feed hole 10 extending inside of the connecting rod 7 and providing communication between the small end hole 8 and the large end hole 9, a piston pin 22 slidably accommodated into the small end hole 8 and secured to the piston 2, and an oil feed groove 23 provided on a sliding surface of the piston pin 22 which slides of a wall portion of the small end hole 8 so as to extend in a center axis direction of the piston pin 22, and positioned so as to communicate with the oil feed hole 10 when the piston 2 is moving from a top dead center to a bottom dead center.

In this sealed compressor, during a compression stroke when a great load is applied to the sliding portion of the piston 22 and of the small end hole 8 of the connecting rod 7, the piston pin 22 contacts the small end hole 8 of the connecting rod 7 at a portion where the oil feed groove 23 is not provided, which makes it difficult for the sliding portion to wear out. During a suction stroke, the oil feed hole 10 of the connecting rod 7 and the oil feed groove 23 of the piston pin 22 conform to each other and are communicated with each other, thereby feeding an oil to the small end hole 8.

In the above stated sealed compressor, the oil feed hole 10 of the connecting rod 7 and the oil feed groove 23 of the piston pin 22 conform to each other and are communicated with each other, for a short time period. Therefore, there is a possibility that the oil is not fed to the small end hole 8 sufficiently. When the oil is not fed to the small end hole 8 sufficiently, a cooling effect provided by the oil is lessened, and insufficient lubrication due to the insufficient oil feeding and a temperature increase in the sliding portion may occur.

SUMMARY OF THE INVENTION

The present invention has been developed to solve the above stated problem, and an object of the present invention is to provide a refrigerant compressor which can sufficiently feed an oil to a sliding surface of a piston pin and of a connecting rod, suppress wear out of the sliding surface, and has high reliability.

To solve the above stated problem associated with the prior art, there is provided a refrigerant compressor comprising an electric element including a stator and a rotor; a compression element actuated by the electric element; and a sealed container which accommodates the electric element and the compression element and reserves lubricating oil; wherein the compression element includes: a crankpin provided at a crankshaft rotated by the rotor; a piston pin provided at a piston which is reciprocatable in an inner space of a cylinder block; and a connecting rod having a large hole portion into which the crankpin is inserted, a small hole portion in which the piston pin is rotatably disposed, and a coupling rod portion for coupling the large hole portion and the small hole portion to each other; wherein an oil guide hole is provided in the coupling rod portion of the connecting rod such that the large hole portion and the small hole portion are communicated with each other via the oil guide hole; a circular first groove is provided on an outer peripheral surface of the piston pin such that the first groove communicates with the oil guide hole; and a second groove extending in a center axis direction of the piston pin is provided in a first region which is on a side opposite to a displacement direction of a load applied to the small hole portion at start of a compression stroke, in two regions into which an inner peripheral surface of the small hole portion of the connecting rod is divided by a virtual line connecting a center axis of the small hole portion of the connecting rod to a center axis of the large hole portion of the connecting rod.

In this configuration, the lubricating oil can be fed sufficiently to the first groove provided on the piston pin from the oil guide hole. Since the first groove and the second groove are communicated with each other, the lubricating oil can be fed sufficiently to the second groove, and thus the lubricating oil can be fed sufficiently to the sliding surface of the piston pin and of the connecting rod. Moreover, since during the compression stroke, the piston pin contacts the connecting rod at the portion where the second groove is not provided and is applied with a load, wear out of the connecting rod and the piston pin can be suppressed.

The above and further objects, features and advantages of the present invention will more fully be apparent from the following detailed description of preferred embodiments with accompanying drawings.

DETAILED DESCRIPTION OF PREFERRED EMBODIMENTS

Figure 1:
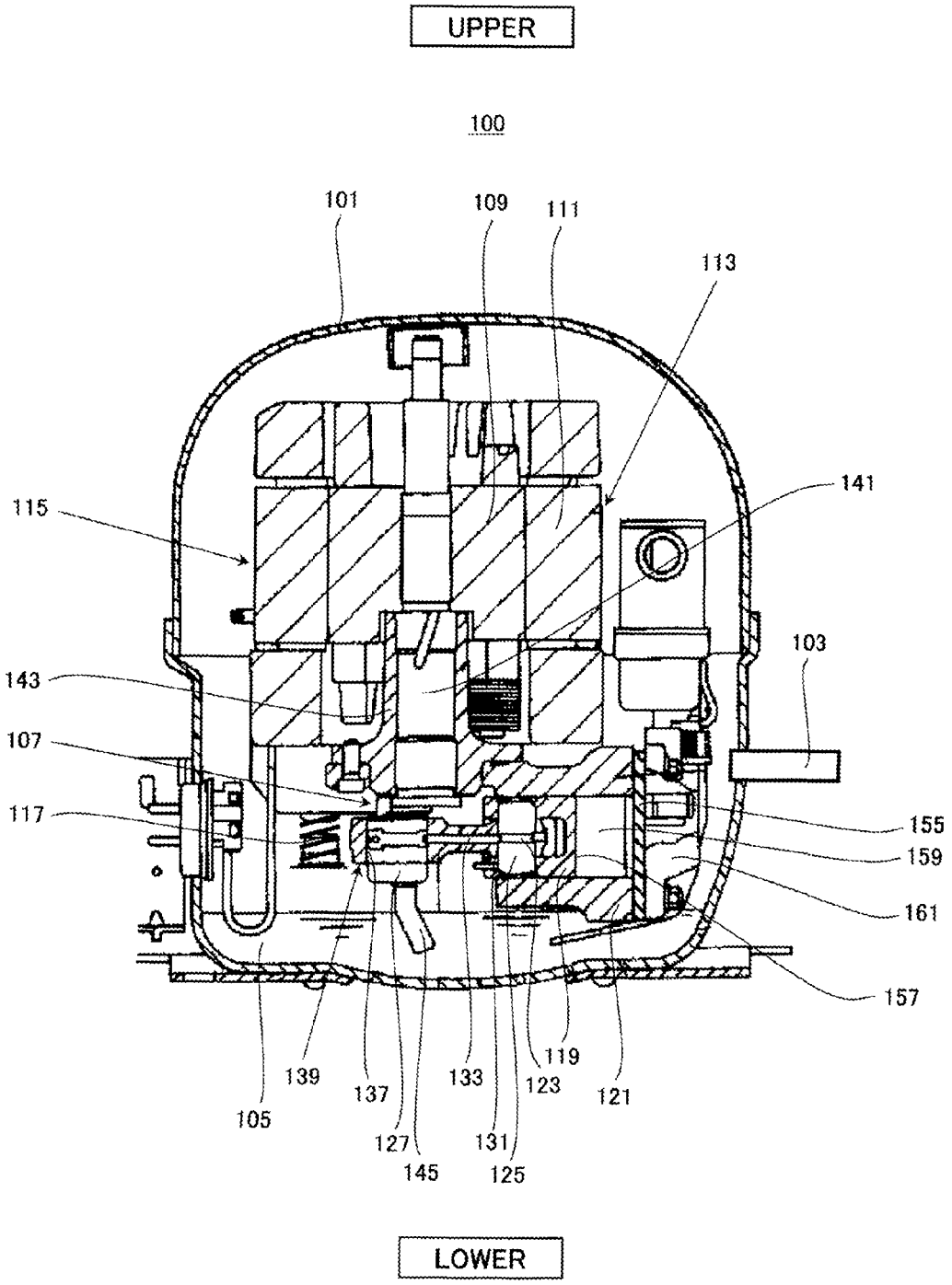
FIG. 1 is a cross-sectional view of a side surface of a refrigerant compressor according to Embodiment 1.

A refrigerant compressor of the present invention comprises: an electric element including a stator and a rotor; a compression element actuated by the electric element; and a sealed container which accommodates the electric element and the compression element and reserves lubricating oil; wherein the compression element includes: a crankpin provided at a crankshaft rotated by the rotor; a piston pin provided at a piston which is reciprocatable in an inner space of a cylinder block; and a connecting rod having a large hole portion into which the crankpin is inserted, a small hole portion in which the piston pin is rotatably disposed, and a coupling rod portion for coupling the large hole portion and the small hole portion to each other; wherein an oil guide hole is provided in the coupling rod portion of the connecting rod such that the large hole portion and the small hole portion are communicated with each other via the oil guide hole; a circular first groove is provided on an outer peripheral surface of the piston pin such that the first groove communicates with the oil guide hole; and a second groove extending in a center axis direction of the piston pin is provided in a first region which is on a side opposite to a displacement direction of a load applied to the small hole portion at start of a compression stroke, in two regions into which an inner peripheral surface of the small hole portion of the connecting rod is divided by a virtual line connecting a center axis of the small hole portion of the connecting rod to a center axis of the large hole portion of the connecting rod.

In this configuration, the lubricating oil can be fed to lubricate the sliding portion of the piston pin and of the connecting rod via the second groove provided on the connecting rod. Therefore, it is possible to provide a highly reliable refrigerant compressor which can effectively lubricate the sliding portion of the piston pin and of the connecting rod and suppress wear out of the sliding portion. During the compression stroke, the piston pin is applied with a load at a portion of the connecting rod where the second groove is not provided, which makes it possible to suppress wear out of the connecting rod and of the piston pin.

In the refrigerant compressor, the second groove may be provided in a portion of the first region which portion is closer to the large hole portion of the connecting rod.

This makes it possible to effectively apply the lubricating oil to the piston pin. As a result, reliability of the compressor can be further improved.

In the refrigerant compressor, an angle formed between the virtual line and a line connecting the second groove to a center axis of the small hole portion of the connecting rod may be in a range from 20 degrees to 60 degrees, when viewed from the center axis direction of the piston.

In this configuration, during the compression stroke, the piston pin is applied with a load at a portion of the connecting rod where the second groove is not provided, which makes it possible to suppress wear out of the connecting rod and of the piston pin. In addition, during a suction stroke of the piston pin, the lubricating oil can be sufficiently fed to the portion of the piston pin which is applied with a load during the compression stroke.

Hereinafter, an embodiment of the present invention will be described with reference to the drawings. Note that the present invention is not limited to the embodiment described below.

Embodiment 1

Configuration of Refrigerant Compressor

FIG. 1 is a cross-sectional view of a side surface of a refrigerant compressor according to Embodiment 1. In FIG. 1, upper and lower sides of the refrigerant compressor are depicted as upper and lower sides of FIG. 1.

Referring to FIG. 1, a refrigerant compressor 100 of Embodiment 1 includes a sealed container 101. The sealed container 101 is provided with a suction pipe 103 penetrating a wall portion of the sealed container 101. A refrigerant gas (not shown) supplied from a refrigeration cycle (not shown) flows through the suction pipe 103 and is fed to inside of the sealed container 101.

Lubricating oil 105 is reserved in a bottom portion of the sealed container 101. Inside of the sealed container 101, a compressor body 115 including a compression element 107 for suctioning and compressing the refrigerant gas and an electric element 113 including a rotor 109 for actuating the compression element 107 and a stator 111 is supported via an elastic member 117 such as a spring.

The compression element 107 includes a crankpin 127 and a cylinder block 121. The crankpin 127 is eccentric with a crankshaft 141 pressed into and fastened to the rotor 109. The crankshaft 141 is disposed such that its center extends in a vertical direction (upward and downward direction) and rotatably retained by a bearing 143. A portion of an oil feed pipe 145 is immersed in the lubricating oil 105 and an upstream end of the oil feed pipe 145 opens in the lubricating oil 105. The oil feed pipe 145 is pressed into and fastened to a lower end portion of the crankpin 127.

The cylinder block 121 is disposed such that its center axis extends horizontally and has a substantially cylindrical shape. The piston 119 is reciprocatingly inserted into the cylinder block 121. A cylindrical piston pin 125 is fastened to the piston 119. The piston pin 125 is coupled to the crankpin 127 by means of a connecting rod 139.

A valve plate 155 is provided at an opening end surface of the cylinder block 121 at a top dead center side so as to close the opening end surface. A cylinder head 161 defining a high-pressure chamber (not shown) is fastened to the valve plate 155 so as to cover the valve plate 155.

The valve plate 155 is provided with a suction port (not shown) and a discharge port (not shown). The suction port is provided with a suction valve (not shown) configured to be opened to communicate an internal space of the cylinder block 121 and an internal space of the sealed container 101 to with each other. The discharge port is provided with a discharge valve device (not shown) which is comprised of a discharge valve and a discharge valve seat and is configured to be opened to communicate the internal space of the cylinder block 121 and the high-pressure chamber to each other.

A compression chamber 159 is defined by the cylinder block 121, the valve plate 155, and an end surface 157 of the piston 119 on the valve plate 155 side.

Next, the components of the refrigerant compressor 100 of Embodiment 1, which are in the vicinity of the piston 119 will be described with reference to FIG. 2 to FIG. 5.

Figure 2:
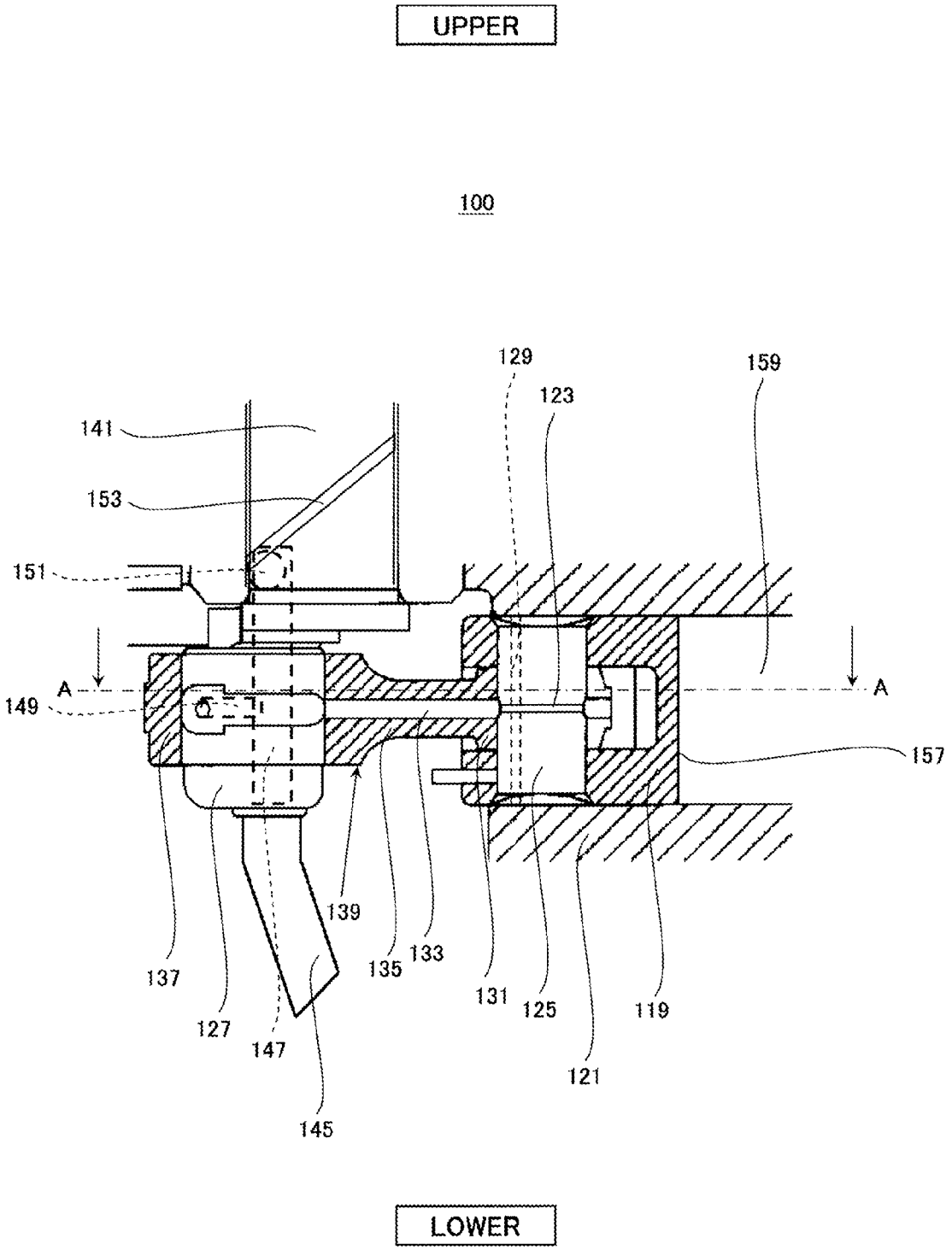
FIG. 2 is a cross-sectional view of major components of the refrigerant compressor of FIG. 1.
Figure 3:
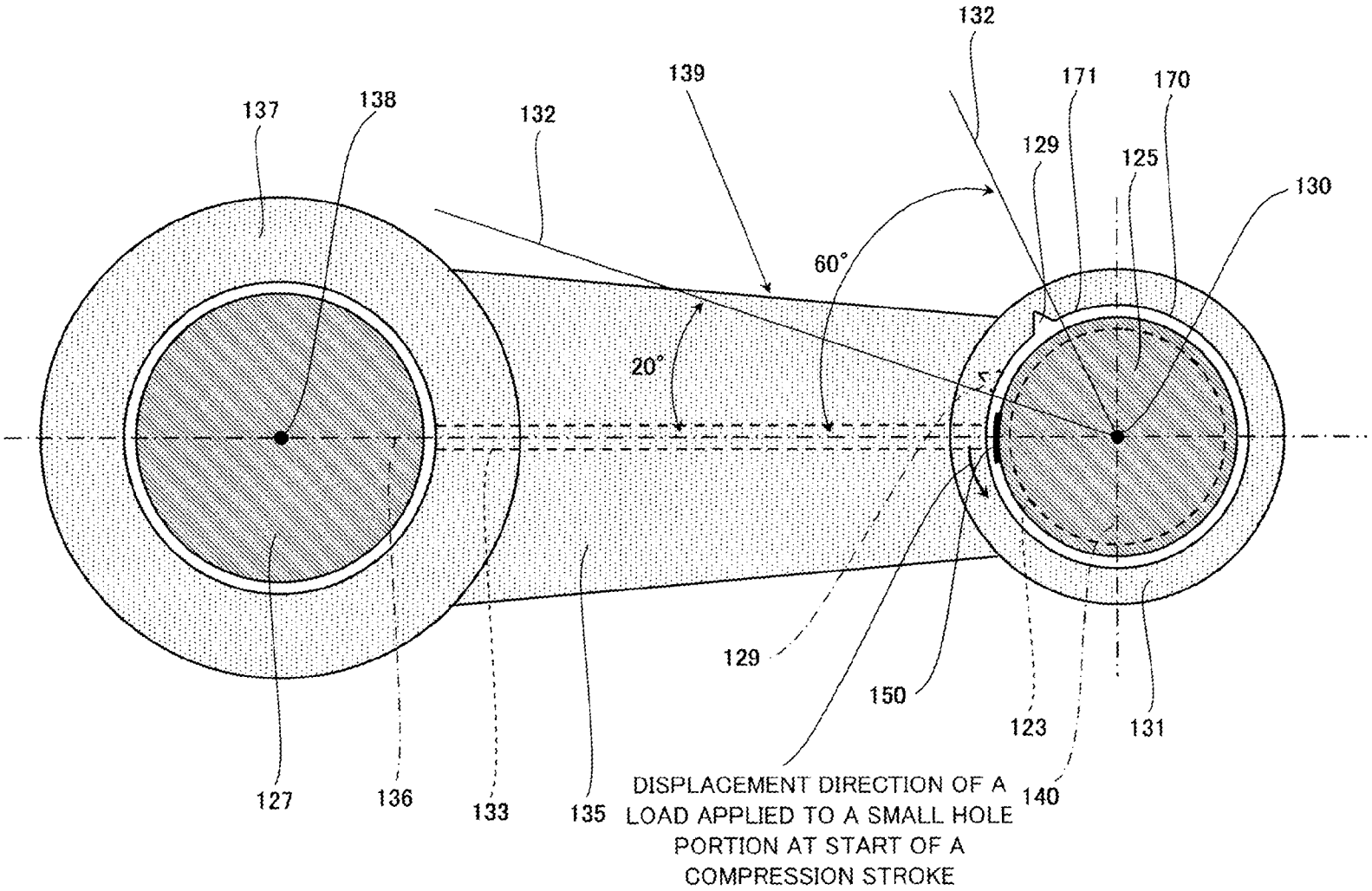
FIG. 3 is a cross-sectional view of the sealed compressor taken along A-A of FIG. 2.
Figure 4:
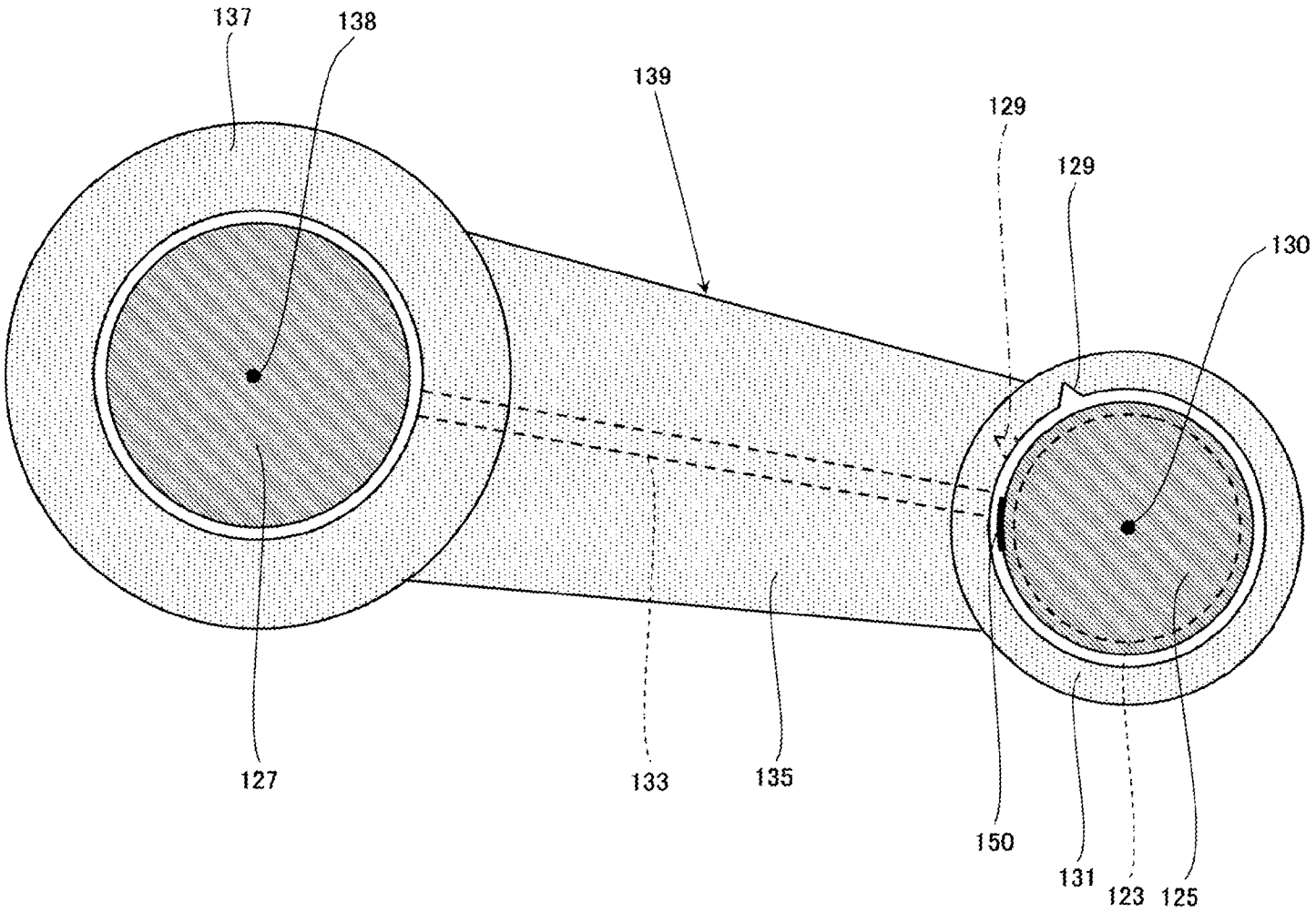
FIG. 4 is a cross-sectional view of the sealed compressor taken along A-A of FIG. 2.
Figure 5:
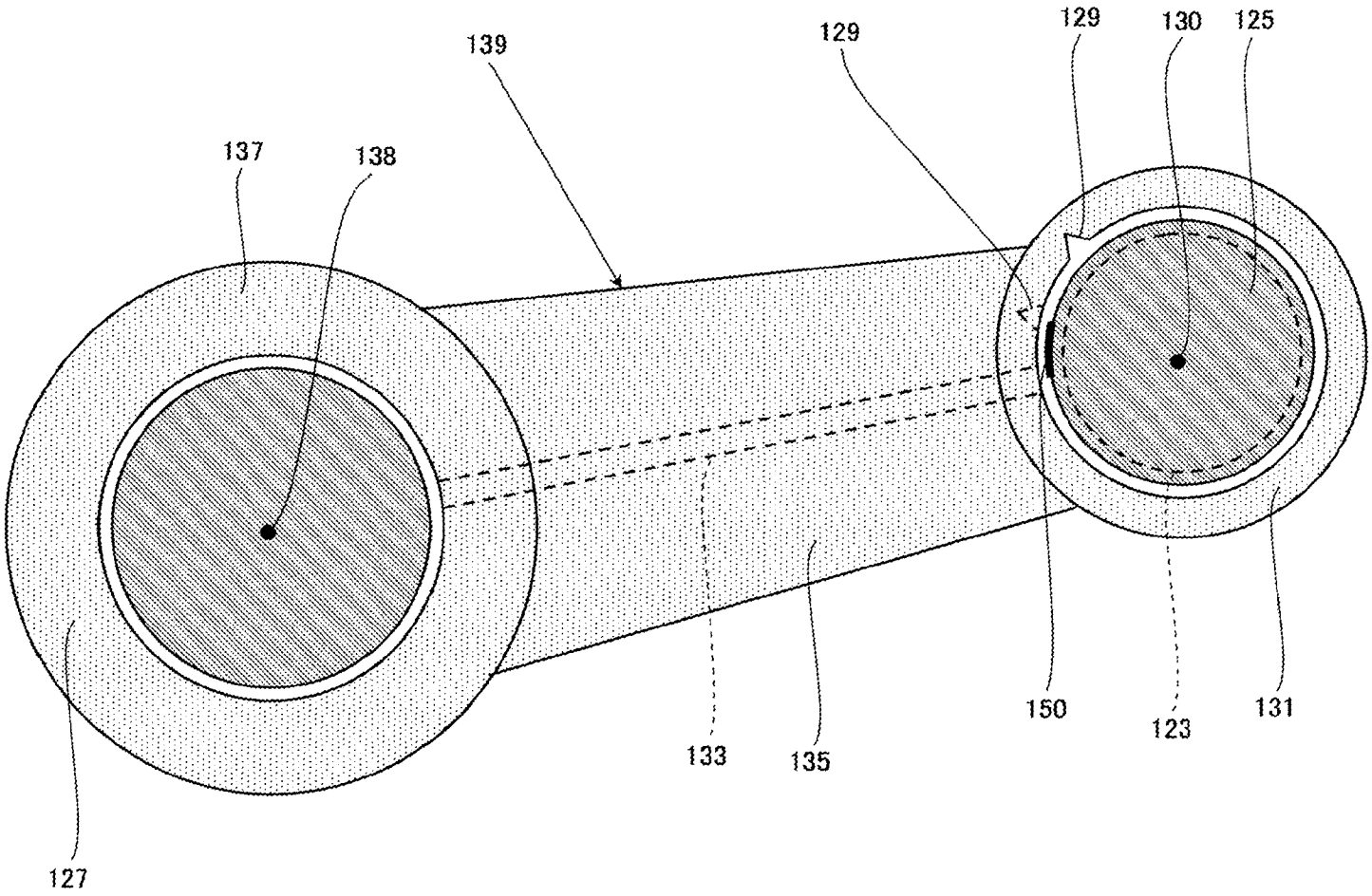
FIG. 5 is a cross-sectional view of the sealed compressor taken along A-A of FIG. 2.
Figure 6:
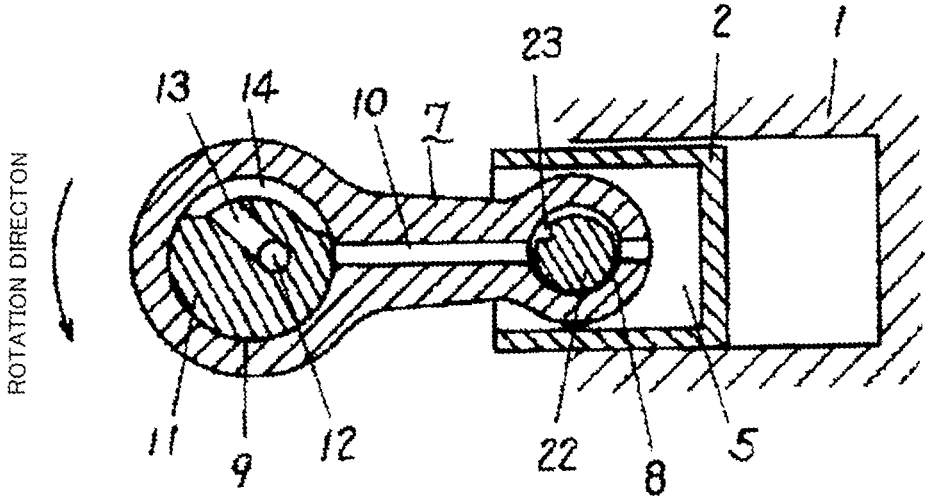
FIG. 6 is a cross-sectional view of a piston device of a sealed compressor disclosed in Japanese Patent No. 2783381.

FIG. 2 is a cross-sectional view of major components of the refrigerant compressor of FIG. 1. FIGS. 3 to 5 are cross-sectional views of the sealed compressor taken along A-A of FIG. 2. FIG. 3 shows the connecting rod 139 and others in a state in which the piston 119 is in a bottom dead center. FIG. 4 shows the connecting rod 139 and others during a compression stroke. FIG. 5 shows the connecting rod 139 and others during a suction stroke. In FIG. 2, upper and lower sides of the refrigerant compressor 100 are depicted as upper and lower sides of FIG. 2. In FIGS. 3 to 5, a part of the configuration is omitted.

As shown in FIGS. 2 to 5, the connecting rod 139 has a large hole portion 137 at one end thereof and a small hole portion 131 at the other end thereof. The large hole portion 137 and the small hole portion 131 are coupled together by means of a coupling rod portion 135 in which a virtual line 136 extends horizontally.

Each of the large hole portion 137 and the small hole portion 131 has a through-hole extending vertically (in upward and downward direction). The crankpin 127 is slidably disposed in the through-hole of the large-hole portion 137. The piston pin 125 is slidably disposed in the through-hole of the small-hole portion 131.

A vertical crankpin hole 147 extending vertically is provided inside of the crankpin 127 such that the vertical crankpin hole 147 communicates with the oil feed pipe 145. The vertical crankpin hole 147 communicates with a horizontal crankshaft hole 151 provided inside of a lower portion of the crankshaft 141. A spiral crankshaft oil groove 153 is provided on a peripheral surface of the crankshaft 141 such that the spiral crankshaft oil groove 153 communicates with the horizontal crankshaft hole 151.

A horizontal crankpin hole 149 extending horizontally is provided inside of the crankpin 127 such that the horizontal crankpin hole 149 communicates with the vertical crankpin hole 147. A tubular oil guide hole 133 extending horizontally is provided in the coupling rod portion 135 of the connecting rod 139 such that the tubular oil guide hole 133 communicates with the horizontal crankpin hole 149 and communicates the small hole portion 131 (to be precise, through-hole of the small hole portion 131) to the large hole portion 137 (to be precise, through-hole of the large hole portion 137). To be more specific, the oil guide hole 133 is provided in a center portion of the coupling rod portion 135 such that the oil guide hole 133 is positioned on a plane passing through a center axis of the crankpin 127 and a center axis of the piston pin 125. Although in the present embodiment, the oil guide hole 133 is provided in the center portion of the coupling rod portion 135, it may be provided in a portion (e.g., portion apart from the plane passing through the center axis of the crankpin 127 and the center axis of the piston pin 125) other than the center portion of the coupling rod portion 135.

A circular first groove 123 is provided on an outer peripheral surface of the piston pin 125 such that the first groove 123 communicates with the oil guide hole 133. A second groove 129 extending in an axial direction of the piston pin 125 is provided on an inner peripheral surface of the small hole portion 131 of the connecting rod 139. That is, in Embodiment 1, the first groove 123 and the second groove 129 are provided in different members (piston pin 125 and the inner peripheral surface of the small hole portion 131) of the connecting rod 139, respectively such that the grooves 123 and 129 are orthogonal to each other.

To be specific, the second groove 129 is provided in a region (first region 170) on a side opposite to a displacement direction (counterclockwise in FIG. 3) of a load applied to the small hole portion 131 at start of the compression stroke, in two regions into which the inner peripheral surface of the small hole portion 131 is divided by a virtual line 136 (center axis of the coupling rod portion 135) connecting a center axis 130 of the small hole portion 131 of the connecting rod 139 to a center axis 138 of the large hole portion 137 of the connecting rod 139. In Embodiment 1, it is supposed that the crankpin 127 rotates in a clockwise direction. A portion of the small hole portion 131, to be precise, a portion of the inner peripheral surface of the small hole portion 131, to which a greatest load is applied during the compression stroke is referred to as a load center.

To be more specific, the second groove 129 is disposed in a portion (first portion 171) of the first region 170 which is closer to the large hole portion 137. In other words, the second groove 129 is disposed in a portion which is on a side opposite to the displacement direction of the load applied to the small hole portion 131 at start of the compression stroke and is closer to the large hole portion 137, in four regions into which the inner peripheral surface of the small hole portion 131 is divided by the virtual line 136 and a virtual line 140 which is orthogonal to the virtual line 136 and passes through the center axis 130.

Typically, in the refrigerant compressor, a pivot movement range of the small hole portion 131 of the connecting rod 139 is about 10 degrees to 20 degrees (less than 20 degrees), around the center axis (virtual line 136) of the coupling rod portion 135 in the state where the piston 119 is in the bottom dead center (or top dead center) in the compression stroke (or suction stroke). A portion 150 of the piston pin 125 to which a load is applied during the compression stroke is in a range which is greater than minus 40 degrees and less than 20 degrees around the center axis (virtual line 136) of the coupling rod portion 135 in the state where the piston 119 is in the bottom dead center (or top dead center), in view of manufacturing errors, etc.

Because of this, to avoid that the second groove 129 faces the portion 150 of the piston pin 125 to which a load is applied during the compression stroke, an angle formed between the virtual line 136 and a line 132 connecting the second groove 129 to the center axis 130 of the small hole portion 131 is preferably equal to or greater than 20 degrees when viewed from the center axis direction of the piston pin 125. In addition, to effectively feed (apply) the lubricating oil 105 to the portion 150 of the piston pin 125 to which the load is applied during the suction stroke, the angle formed between the line 132 and the virtual line 136 is preferably equal to or less than 60 degrees.

[Operation of Refrigerant Compressor]

Next, the operation of the refrigerant compressor 100 of Embodiment 1 will be described with reference to FIGS. 1 to 5.

Upon the rotor 109 of the electric element 113 rotating, the crankshaft 141 rotates. An eccentric (turn) motion of the crankpin 127 is converted into a linear reciprocation motion by the connecting rod 139. The piston 119 reciprocates within the cylinder block 121. Thus, a predetermined suction operation (suction stroke) and a predetermined compression operation (compression stroke) are performed.

At this time, the oil feed pipe 145 attached to a tip end of the crankpin 127 rotates in the lubricating oil 105 and thereby suctions up the lubricating oil 105 by a centrifugal pump function. The lubricating oil 105 suctioned up into the oil feed pipe 145 is fed to the crankshaft oil groove 153 through the vertical crankpin hole 147 and the horizontal crankshaft hole 151.

A portion of the lubricating oil 105 flowing through the vertical crankpin hole 147 is fed to the oil guide hole 133 provided in the coupling rod portion 135 of the connecting rod 139 through the horizontal crankpin hole 149. The lubricating oil 105 flows through the oil guide hole 133 and is fed to the first groove 123 provided in the piston pin 125, and then to the second groove 129.

The lubricating oil 105 in the second groove 129 is applied to the outer peripheral surface (in particular, portion 150 of the piston pin 125 to which the load is applied during the compression stroke) of the piston pin 125 while the connecting rod 139 and/or the piston pin 125 is/are displaced pivotally (moved pivotally). Specifically, during the suction stroke, the second groove 129 comes closer to the portion 150 of the piston pin 125 to which the load is applied during the compression stroke while the connecting rod 139 and/or the piston pin 125 is/are displaced pivotally, and thereafter moves away from the portion 150. Thereby, the lubricating oil 105 is applied to the outer peripheral surface of the piston pin 125.

[Advantages of Refrigerant Compressor]

Next, advantages achieved by the refrigerant compressor 100 of Embodiment 1 will be described with reference to FIGS. 1 to 5.

As described above, in the refrigerant compressor 100 of Embodiment 1, the first groove 123 is provided on the inner peripheral surface of the piston pin 125 such that the first groove 123 communicates with the oil guide hole 133, and the second groove 129 is provided on the inner peripheral surface of the small hole portion 131 of the connecting rod 139. This makes it possible to sufficiently feed the lubricating oil 105 to the first groove 123 and to the second groove 129 from the oil guide hole 133 more sufficiently as compared to the above stated conventional sealed compressor.

In the refrigerant compressor 100 of Embodiment 1, the first groove 123 and the second groove 129 are provided on different members, respectively. Because of this, an edge with a right angle or an acute angle with respect to a sliding direction will not be formed, which would be formed due to a fact that the first groove 123 and the second groove 129 which are provided on the same member cross each other. This makes it possible to suppress a damage or a wear out of the piston pin 125 or the small hole portion 131 as compared to a case where the first groove 123 and the second groove 129 are provided on the same member.

In the refrigerant compressor 100 of Embodiment 1, during the compression stroke, as shown in FIG. 4, the second groove 129 is displaced away from the portion 150 of the piston pin 125 to which the load is applied so that the second groove 129 does not face the portion 150. Because of this, an oil film pressure is generated easily between the inner peripheral surface of the small hole portion 131 and the portion 150 of the piston pin 125, which can suppress wear out of these portions.

In the refrigerant compressor 100 of Embodiment 1, during the suction stroke, as shown in FIG. 5, the second groove 129 is displaced (moved) closer to the portion facing the portion 150. Because of this, the lubricating oil 105 can be applied to the outer peripheral surface of the piston pin 125 (in particular, portion 150 of the piston pin 125 to which the load is applied during the compression stroke). This makes it possible to sufficiently feed the lubricating oil 105 for lubricating the sliding portion of the piston pin 125 and the small hole portion 131. Thus, the sliding portion can be lubricated effectively and wear out of these portions can be suppressed.

Even in a case where the second groove 129 is provided such that the angle formed between the line 132 and the virtual line 136 is 60 degrees, the sliding portion of the piston pin 125 and the small hole portion 131 can be lubricated effectively for the reasons described below.

A portion of the lubricating oil 105 applied to a portion of the outer peripheral surface of the piston pin 125 which is away from the portion 150 is applied to a portion of the inner peripheral surface of the small hole portion 131 which is closer to the portion 150 than the second groove 129, during a next suction stroke. Then, during the following next suction stroke, the lubricating oil 105 applied to the inner peripheral portion of the small hole portion 131 is applied to a portion of the outer peripheral surface of the piston pin 125 which is closer to the portion 150. Thus, while the suction stroke and the compression stroke are occurring in repetition, an application location of the lubricating oil 105 shifts toward the portion 150. As a result, a sufficient lubricating effect can be achieved.

A refrigerant compressor of the present invention is useful because it is capable of sufficiently feeding lubricating oil to sliding surface of a piston pin and of a connecting rod, and suppressing wear out of the connecting rod and of the piston pin.

Numeral modifications and alternative embodiments of the present invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A refrigerant compressor comprising:

an electric element including a stator and a rotor;

a compression element actuated by the electric element; and a sealed container which accommodates the electric element and the compression element and reserves lubricating oil;

wherein the compression element includes:

a crankpin provided at a crankshaft rotated by the rotor;

a piston pin provided at a piston which is reciprocatable in an inner space of a cylinder block; and a connecting rod having a large hole portion into which the crankpin is inserted, a small hole portion in which the piston pin is rotatably disposed, and a coupling rod portion for coupling the large hole portion and the small hole portion to each other;

wherein an oil guide hole is provided in the coupling rod portion of the connecting rod such that the large hole portion and the small hole portion are communicated with each other via the oil guide hole;

a circular first groove is provided on an outer peripheral surface of the piston pin such that the first groove communicates with the oil guide hole; and a second groove extending in a center axis direction of the piston pin is provided in a first region which is on a side opposite to a displacement direction of a load applied to the small hole portion at start of a compression stroke, in two regions into which an inner peripheral surface of the small hole portion of the connecting rod is divided by a virtual line connecting a center axis of the small hole portion of the connecting rod to a center axis of the large hole portion of the connecting rod.

2. The refrigerant compressor according to claim 1, wherein the second groove is provided in a portion of the first region which portion is closer to the large hole portion of the connecting rod.

3. The refrigerant compressor according to claim 2, wherein an angle formed between the virtual line and a line connecting the second groove to a center axis of the small hole portion of the connecting rod is in a range from 20 degrees to 60 degrees when viewed from the center axis direction of the piston pin.

* * * * *